US009915250B2

(12) United States Patent
Brasche et al.

(10) Patent No.: US 9,915,250 B2
(45) Date of Patent: Mar. 13, 2018

(54) HYDRAULIC DRIVE SYSTEM FOR CRYOGENIC PUMP

(71) Applicant: Caterpillar Inc., Peoria, IL (US)

(72) Inventors: Adrienne M. Brasche, Peoria, IL (US); Cory A. Brown, Peoria, IL (US); Sunil J. Bean, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 255 days.

(21) Appl. No.: 14/833,847

(22) Filed: Aug. 24, 2015

(65) Prior Publication Data

US 2017/0058878 A1 Mar. 2, 2017

(51) Int. Cl.
*F04B 15/08* (2006.01)
*F04B 49/22* (2006.01)
(Continued)

(52) U.S. Cl.
CPC ..... *F04B 15/08* (2013.01); *F01L 9/02* (2013.01); *F04B 7/04* (2013.01); *F04B 9/1178* (2013.01); *F04B 19/22* (2013.01); *F04B 37/08* (2013.01); *F04B 37/085* (2013.01); *F04B 49/22* (2013.01); *F04B 49/225* (2013.01); *F04B 53/10* (2013.01); *F04B 53/14* (2013.01); *F04B 53/146* (2013.01); *F04B 53/148* (2013.01);
(Continued)

(58) Field of Classification Search
CPC ..... F04B 2015/081; F04B 2015/0812; F04B 2015/0814; F04B 2015/0816; F04B 2015/0818; F04B 2015/082; F04B 2015/0822; F04B 2015/0824; F04B 2015/0826; F04B 15/08; F04B 7/04; F04B 49/22; F04B 49/225; F04B 53/10; F04B 19/22; F04B 53/14; F04B 53/146; F04B 53/148; F04B 37/08; F04B 37/085; F17C 2227/0135; F17C 2227/0142; F17C 2227/0178; Y10S 417/901
See application file for complete search history.

(56) References Cited

U.S. PATENT DOCUMENTS 3,126,835 A * 3/1964 Kline ..... F04B 1/126 123/43 A
3,212,280 A * 10/1965 Thomas ..... F04B 7/0073 417/520
(Continued)

FOREIGN PATENT DOCUMENTS

GB 937647 A 9/1963
GB 1126751 A 9/1968
(Continued)

*Primary Examiner* — Keith Raymond
(74) *Attorney, Agent, or Firm* — Leydig, Voit & Mayer, Ltd.

(57) ABSTRACT

A drive system for a cryogenic pump is provided including a spool housing having a plurality of valves disposed therein about a pump axis and a tappet housing including a plurality of tappet bores, each tappet bore in communication with a respective one of the plurality of valves. A collection cavity collects hydraulic fluid from the tappet bores. A pump flange includes a fluid inlet and a fluid outlet. An inlet manifold directs hydraulic fluid received through the fluid inlet to each of the plurality of valves. An outlet manifold directs hydraulic fluid from each of the valves and the collection cavity to the fluid outlet.

20 Claims, 8 Drawing Sheets

(51) Int. Cl.

| | |
|---|---|
| ***F04B 53/14*** | (2006.01) |
| ***F04B 7/04*** | (2006.01) |
| ***F01L 9/02*** | (2006.01) |
| ***F04B 37/08*** | (2006.01) |
| ***F04B 53/10*** | (2006.01) |
| ***F04B 19/22*** | (2006.01) |
| ***F04B 9/117*** | (2006.01) |

(52) U.S. Cl.
CPC . *F04B 2015/081* (2013.01); *F17C 2227/0135* (2013.01); *F17C 2227/0142* (2013.01); *F17C 2227/0178* (2013.01); *Y10S 417/901* (2013.01)

(56) References Cited

U.S. PATENT DOCUMENTS

| | | | | |
|---|---|---|---|---|
| 3,667,437 | A * | 6/1972 | Dreisin | F02D 1/10 123/449 |
| 5,411,374 | A | 5/1995 | Gram | |
| 5,819,544 | A | 10/1998 | Andonian | |
| 6,264,437 | B1 * | 7/2001 | Porel | F02M 59/04 105/96.1 |
| 6,354,088 | B1 | 3/2002 | Emmer et al. | |
| 2006/0260331 | A1 | 11/2006 | Andreychuk | |

FOREIGN PATENT DOCUMENTS

| | | |
|---|---|---|
| JP | 2003184684 | 7/2003 |
| KR | 1020140098824 | 8/2014 |

* cited by examiner

HYDRAULIC DRIVE SYSTEM FOR CRYOGENIC PUMP

TECHNICAL FIELD

This disclosure relates generally to cryogenic pumps and, more particularly, to a hydraulic drive system for a cryogenic pump.

BACKGROUND

Many large mobile machines such as mining trucks, locomotives, marine applications and the like have recently begun using alternative fuels, alone or in conjunction with traditional fuels, to power their engines. For example, large displacement engines may use a gaseous fuel, alone or in combination with a traditional fuel such as diesel, to operate. Because of their relatively low densities, gaseous fuels, for example, natural gas or petroleum gas, are carried onboard vehicles in liquid form. These liquids, the most common including liquefied natural gas (LNG) or liquefied petroleum gas (LPG), can be cryogenically stored in insulated tanks on the vehicles, or may alternatively be stored at an elevated pressure, for example, a pressure between 30 and 300 psi in a pressurized vessel. In either case, the stored fuel can be pumped, evaporated, expanded, or otherwise placed in a gaseous form in metered amounts and provided to fuel the engine.

To store and utilize cooled natural gas in compressed or liquefied forms onboard mobile machines, specialized storage tanks and fuel delivery systems may be required. This equipment may include a double-walled cryogenic tank and a pump for delivering the LNG or LPG to the internal combustion engine for combustion. The pumps that are typically used to deliver the LNG to the engine of the machine include pistons, which deliver the LNG to the engine. Such piston pumps, which are sometimes also referred to as cryogenic pumps, will often include a single piston that is reciprocally mounted in a cylinder bore. The piston is moved back and forth in the cylinder to draw in and then compress the gas. Power to move the piston may be provided by different means, the most common being electrical, mechanical or hydraulic power.

One example of a cryogenic pump can be found in U.S. Pat. No. 3,212,280 (the '280 patent), which describes a pumping system for volatile liquids that includes three individual pumping units that are contained within a bell-shaped housing. The individual pumps each include a single piston that may be driven by a mechanical slider crank drive mechanism. The drive mechanism is disposed outside of the tank.

SUMMARY

In one aspect, the disclosure describes a cryogenic pump for pumping liquid from a cryogenic tank. The cryogenic pump includes a pump assembly adapted to be submersed within a cryogenic tank and a hydraulic drive assembly for driving the pump assembly to pump liquid. The hydraulic drive assembly further includes a spool housing having a plurality of valves disposed therein about a pump axis and a tappet housing including a plurality of tappet bores, each tappet bore in communication with a respective one of the plurality of valves. A collection cavity collects hydraulic fluid from the tappet bores. A pump flange mounts the cryogenic pump to a cryogenic tank. The pump flange includes a fluid inlet for receiving hydraulic fluid and a fluid outlet for directing hydraulic fluid out of the cryogenic pump. An inlet manifold is disposed at least partially in the spool housing and directs hydraulic fluid received through the fluid inlet to each of the plurality of valves. An outlet manifold directs hydraulic fluid from each of the valves and the collection cavity to the fluid outlet.

In another aspect, the disclosure describes a power system for a machine including a cryogenic tank for storing a cryogenic fluid, an engine operatively associated with the cryogenic tank for receiving the cryogenic fluid and a hydraulic system including a hydraulic pump and a hydraulic reservoir. A cryogenic pump is arranged in the cryogenic tank, the cryogenic pump having a pump assembly submersed within the cryogenic tank and a hydraulic drive assembly for driving the pump assembly to pump the cryogenic liquid. The hydraulic drive assembly further includes a spool housing having a plurality of valves disposed therein arranged about a pump axis and a tappet housing including a plurality of tappet bores. Each tappet bore is in communication with a respective one of the plurality of valves. A collection cavity collects hydraulic fluid from the tappet bores. A pump flange mounts the cryogenic pump to a cryogenic tank. The pump flange includes a fluid inlet in communication with the hydraulic pump and a fluid outlet in communication with the hydraulic reservoir. An inlet manifold is disposed at least partially in the spool housing and directs hydraulic fluid received through the fluid inlet to each of the plurality of valves. An outlet manifold is disposed at least partially in the spool housing and directs hydraulic fluid from each of the valves and the collection cavity to the fluid outlet.

In yet another aspect, the disclosure describes a drive system for a cryogenic pump. The drive system includes a spool housing having a plurality of valves disposed therein about a pump axis. A tappet housing includes a plurality of tappet bores, each tappet bore in communication with a respective one of the plurality of valves. A collection cavity collects hydraulic fluid from the tappet bores. A pump flange mounts the cryogenic pump to the cryogenic tank. The pump flange includes a fluid inlet for receiving hydraulic fluid and a fluid outlet for directing hydraulic fluid out of the cryogenic pump. A center passage is disposed at least partially in a space in the spool housing that is circumscribed by the plurality of valves. An annular passage is disposed at least partially in the spool housing. An inlet manifold directs hydraulic fluid received through the fluid inlet to each of the plurality of valves. The outlet manifold includes one of the center passage and the annular passage. An outlet manifold directs hydraulic fluid from each of the valves and the collection cavity to the fluid outlet. The inlet manifold includes the other of the center passage and the annular passage.

DETAILED DESCRIPTION

Figure 1:
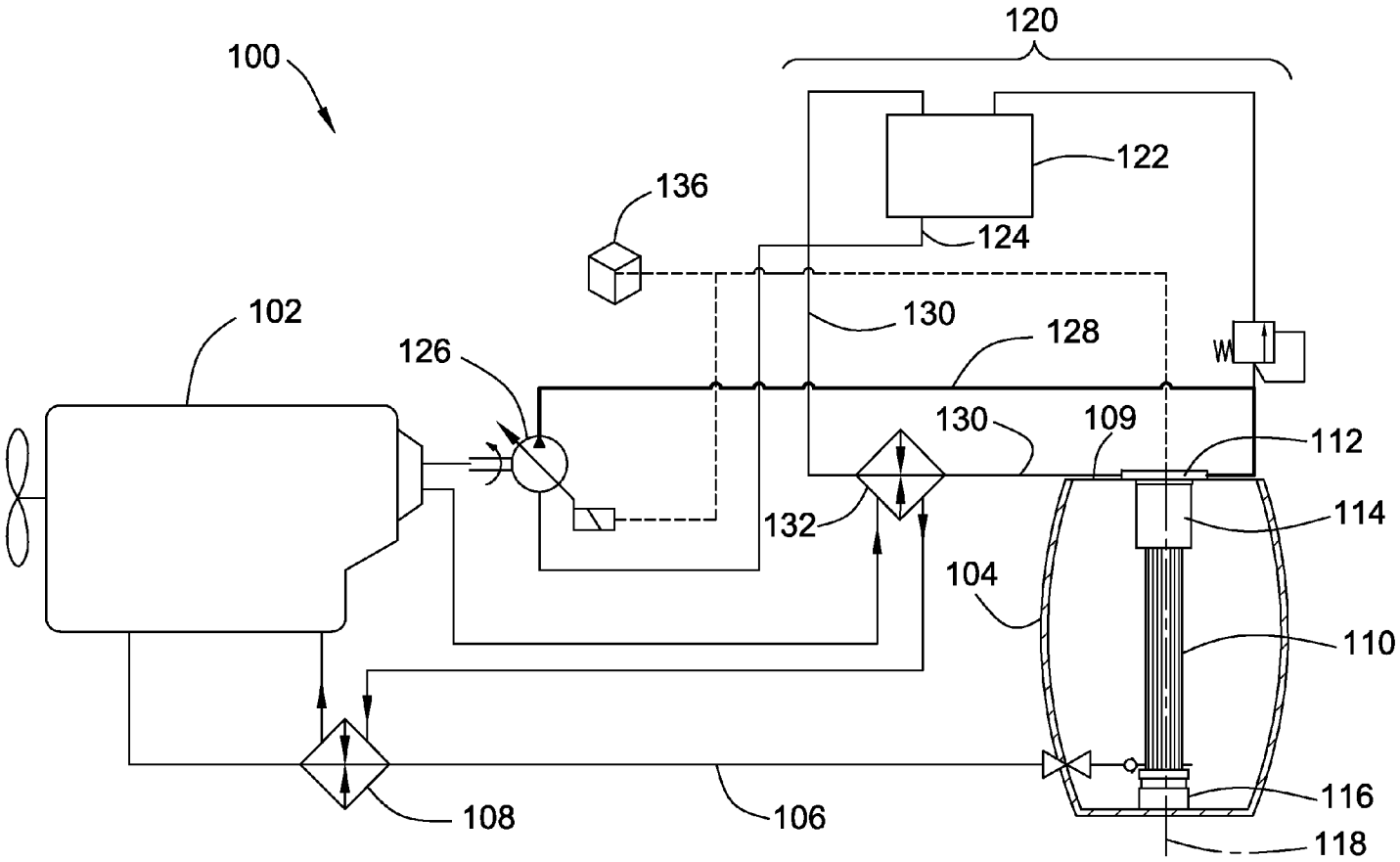
FIG. 1 is a schematic block diagram representative of a liquefied natural gas (LNG) power system.

This disclosure relates to a system that combusts compressed natural gas (CNG) or liquefied natural gas (LNG), maintained at cryogenic temperatures, in an internal combustion engine for power. Referring to FIG. 1, there is illustrated a representative schematic diagram of an LNG power system 100 for combusting and converting LNG to motive power for the machine. The machine may be any various type of machine for performing some type of works in an industry such as mining, construction, farming, transportation, or any other industry known in the art. For example, the machine may be an earth-moving machine, such as a wheel loader, excavator, dump truck, backhoe, motor grader, material handler, mining truck, locomotive or the like. In other embodiments, the machine may be a stationary machine for powering pumps, compressors, generators, or the like. The foregoing uses of the LNG power system 100 are representative only and should not be considered a limitation on the claims of the present disclosure. The described LNG power system 100 may, in the alternative, operate on CNG.

The LNG power system 100 can include an internal combustion engine 102 that can receive LNG fuel from a cryogenic tank 104 that may be located on or in close proximity to the machine. The internal combustion engine 102 can include pistons, cylinders, an air mass flow system and other components operably arranged to combust LNG and covert the chemical energy therein into a mechanical motion as is known in the art. In other embodiments, the internal combustion engine may be replaced with a different type of combustion engine such as a turbine. To communicate LNG from the cryogenic tank 104 to the internal combustion engine 102, the LNG power system 100 can include a fuel line 106 in the form of cryogenic hose or the like. In an embodiment, to facilitate the combustion process, the LNG may be converted back to a gaseous or vaporized phase prior to introduction to the internal combustion engine 102 by a vaporizer 108 disposed in the fuel line 106.

Figure 2:
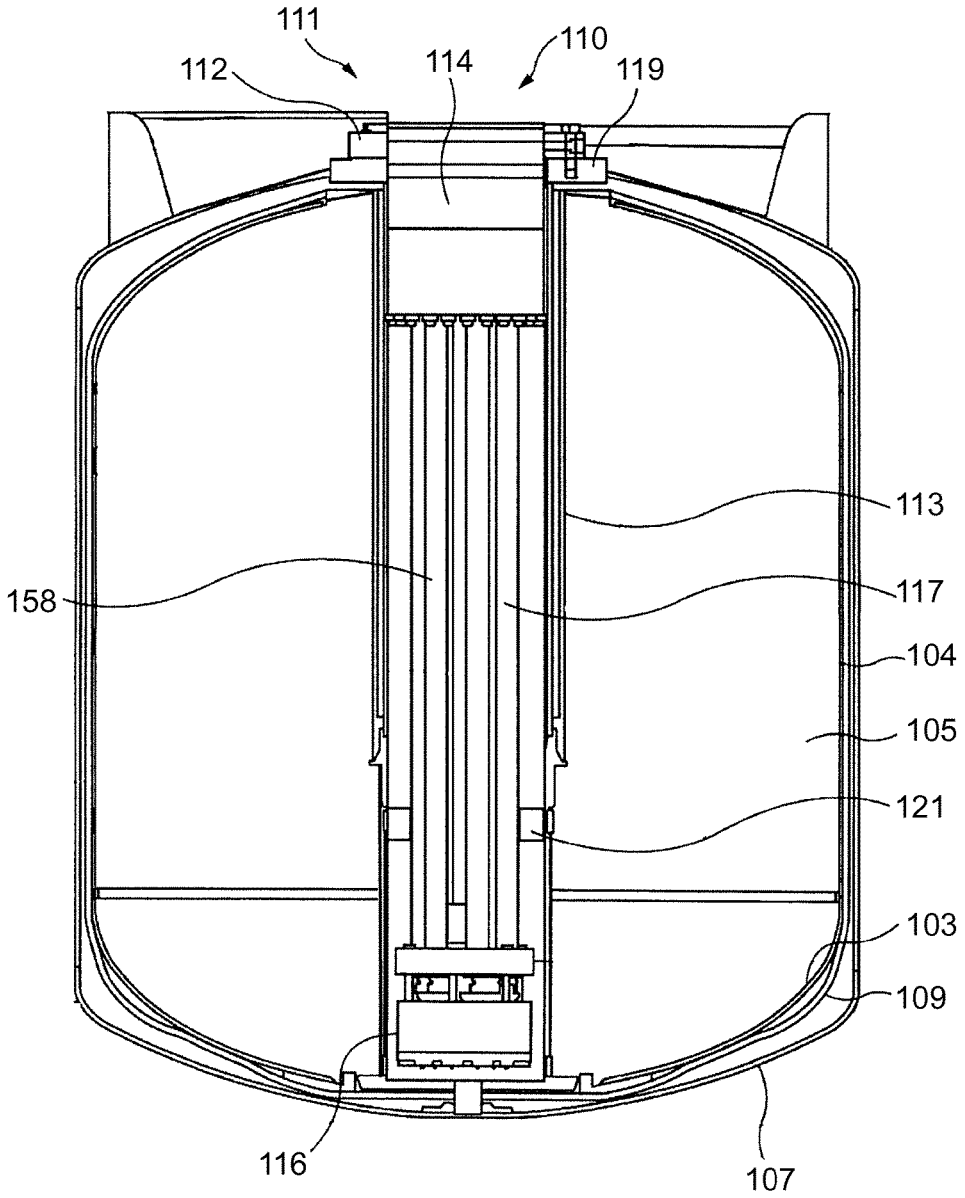
FIG. 2 is a section view the cryogenic pump and cryogenic tank of FIG. 1.

To direct the LNG from the cryogenic tank 104 to the internal combustion engine 102, a cryogenic pump 110 adapted for operation at cryogenic temperatures is partially disposed within the tank. A section view of the tank 104 having the pump 110 at least partially disposed therein is shown in FIG. 2. The cryogenic tank 104 may be of a double-walled, vacuum-sealed construction like a Dewar flask or of a similar, heavily insulated construction and may be of any suitable size or storage volume. For example, the tank 104 may include an inner wall 103, which defines a chamber 105 containing the pressurized LNG, and an outer wall 107. A layer of insulation 109 may optionally be used, and/or a vacuum may be created along a gap between the inner wall 103 and the outer wall 107. Both the inner wall 103 and the outer wall 107 have a common opening 111 at one end of the tank, which surrounds a cylindrical casing 113 that extends into a tank chamber 105. The cylindrical casing 113 is hollow and defines a pump socket 117 therein that extends from a mounting flange 119 into the tank chamber 105 and accommodates the cryogenic pump 110 therein. A seal 121 separates the interior of a portion of the pump socket 117 from the tank chamber 105.

Figure 3:
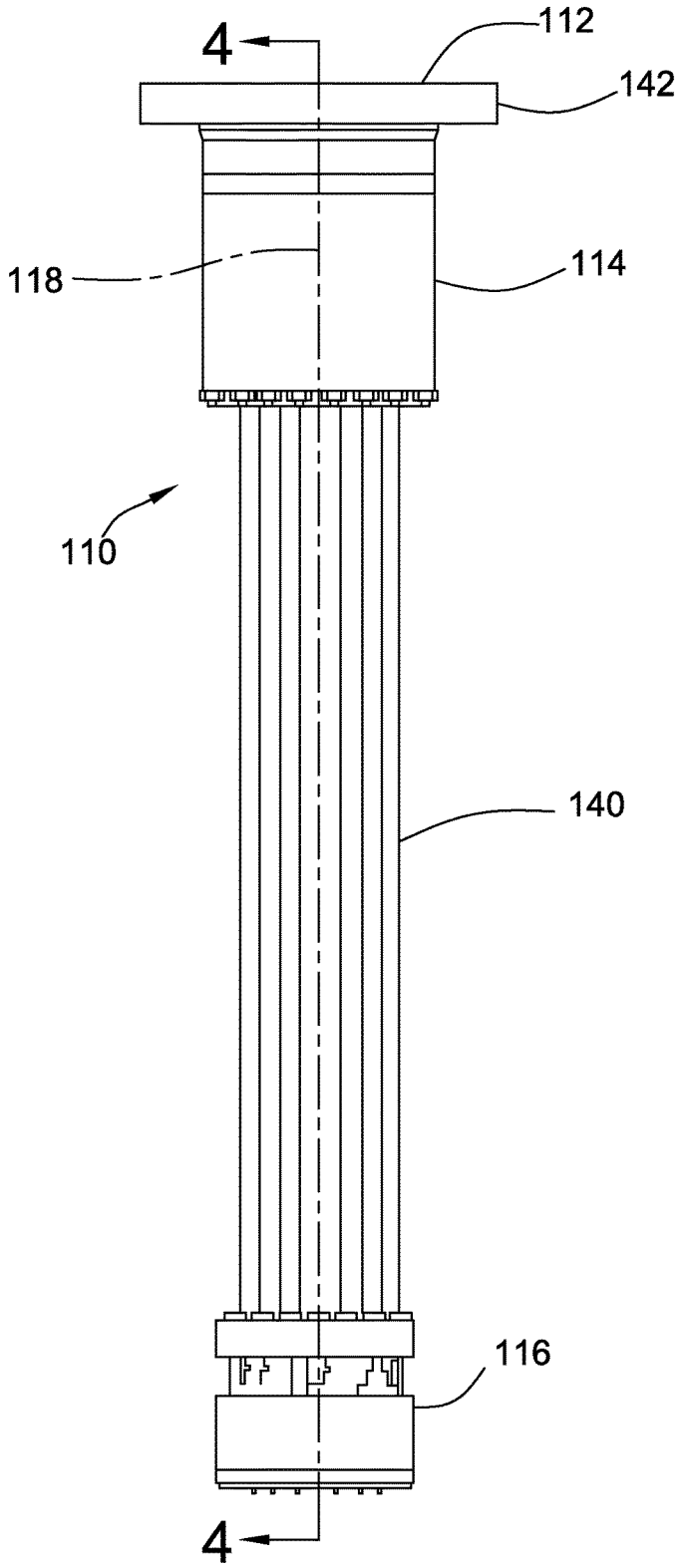
FIG. 3 is a side view of the cryogenic pump of FIG. 1 removed from the cryogenic tank.

Referring to FIGS. 2 and 3, in the illustrated embodiment, the cryogenic pump 110 is vertically arranged with respect to the cryogenic tank 104 and includes a pump flange 112 that supports the cryogenic pump 110 on the mounting flange 119 of the tank 104. The cryogenic pump 110 can have an elongated shape to extend proximate to the bottom of the cryogenic tank 104. The cryogenic pump 110 may have a hydraulic drive assembly 114 associated with the pump flange 112 thermally connected to the outer wall 107 (sometimes referred to as the "warm end") and a pump assembly 116 disposed at the bottom of the cryogenic tank 104 and that may be submerged in cryogenic fluid such as LNG when the tank is full (sometimes referred to as the "cold end"). The elongated shape of the cryogenic pump 110 further is characterized by a pump axis 118 extending between the spaced-apart drive assembly and pump assembly 114, 116 of the pump.

To drive the cryogenic pump 110, the hydraulic drive system 114 may be operatively associated with pumping elements disposed in the pump assembly 116. Referring again to FIG. 1, the hydraulic drive assembly 114 may therefore be in fluid communication with a hydraulic system 120 that is associated with the LNG power system 100. To store hydraulic fluid, the hydraulic system 120 can included a hydraulic reservoir 122 of any suitable volume and that may normally maintain the hydraulic fluid near atmospheric pressure. For pressurizing and directing hydraulic fluid through the hydraulic system 120, a first hydraulic line 124 can establish communication between the hydraulic reservoir 122 and a hydraulic pump 126. The hydraulic pump 126 can be of any suitable construction and may be a metered or variable volume pump for adjustably controlling the quantity of hydraulic fluid directed through the hydraulic system. A second hydraulic line 128 can establish fluid communication between the outlet of the hydraulic pump 126 and the hydraulic drive assembly 114 of the cryogenic pump 110. To return hydraulic fluid to the hydraulic system 120, a third hydraulic line 130 extends from the hydraulic drive assembly 114 back to the hydraulic reservoir 122. The third hydraulic line 130 may also pass through a cooler 132 or heat exchanger after exiting the cryogenic pump 110 for cooling one or more fluids operatively associated with the internal combustion engine 102.

To control the LNG power system 100 and/or the hydraulic system 120, an electronic controller 136 can be operatively associated with and in electronic communication with the components of the systems as indicated by the dashed lines. The controller 136 may be in the form of a microprocessor, an application specific integrated circuit (ASIC), or may include other appropriate circuitry and may have memory or other data storage capabilities. The controller 136 may also include or be capable of performing functions, steps, routines, data tables, data maps, charts and the like saved in and executable from read-only memory or another electronically accessible storage medium to control the LNG power system and/or hydraulic system. Although in the embodiment illustrated in FIG. 1, the controller is shown as a single, discrete unit, in other embodiments, the controller and its functions may be distributed among a plurality of distinct and separate components. The controller can also be operatively associated with various sensors, inputs, and controls arranged about the systems with electronic communication between components being established by communication lines such as wires, dedicated buses, and radio waves, using digital or analog signals.

Referring to FIG. 3, there is illustrated the cryogenic pump 110 having the hydraulic drive assembly 114 extending downward from the pump flange 112 and the pump assembly 116 disposed for submersion in the LNG stored in the cryogenic tank. The cryogenic pump 110 can also include a connecting rod body 140 having an elongated, generally tubular shape extending between and interconnecting the hydraulic drive assembly 114 and the pump assembly 116. The connecting rod body 140 can delineate the pump axis 118 that aligns with the vertical extension of the elongated cryogenic pump 110 when installed in the cryogenic tank. To support the cryogenic pump 110 as it depends downward into the cryogenic tank, the pump flange 112 includes a flange shoulder 142 protruding radially outward from the pump axis 118 and which can join to or rest atop the exterior shell of the tank such as shown in FIG. 2.

Figure 4:
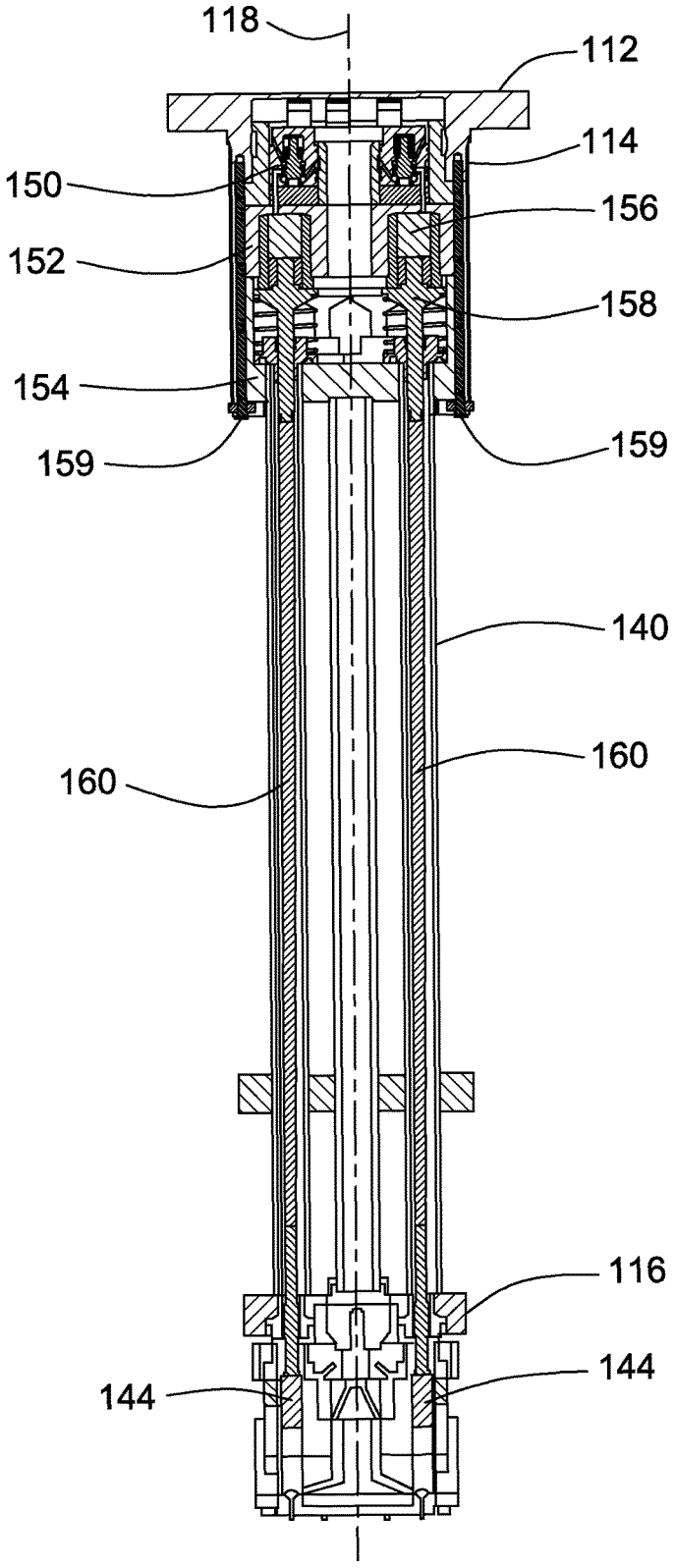
FIG. 4 is a cutaway, side view of the cryogenic pump taken along line 4-4 of FIG. 3.

Referring to FIG. 4, to pump LNG, the pump assembly 116 may include a plurality of pumping elements 144 in the form of reciprocal plungers adapted to move up and down with respect to the pump axis 118 and thereby generate a pumping action. The pumping elements 144 may move in a sequential and alternating manner to provide a consistent output of LNG from the cryogenic pump 110. In an embodiment, the pump assembly 116 may include six pumping elements 144 arranged concentrically about the pump axis 118, but in other embodiments, different numbers and arrangements of pumping elements are contemplated and fall within the scope of the disclosure.

To drive the pumping elements 144, as noted above, the hydraulic drive assembly 114 may be configured to convert the hydraulic pressure associated with the hydraulic fluid into reciprocal motion that is directed generally parallel with the pump axis. The components of the hydraulic drive assembly or system may include an uppermost spool housing 150 located underneath the pump flange 112, a tappet housing 152 arranged vertically below the spool housing, and spring housing 154 disposed vertically below the tappet housing. The tappet housing 152 can include a plurality of tappets 156 slidably disposed and vertically movable therein and which abut a plurality of pushrods 158 partially accommodated in the spring housing 154. The pushrods 158 can depend below the spring housing 154 to abut against a respective number of connecting rods 160 that extend through the tubular connecting rod housing 140 from the hydraulic drive assembly 114 to the pump assembly 116 and that are operatively associated with the pumping elements 144. Accordingly, when the tappets and pushrods are driven to reciprocate along the pump axis 118 by force of the hydraulic fluid, the connecting rods 160 transfer the up-and-down motion to the pumping elements 144. The different components of the hydraulic drive assembly 114 may be secured together in vertical alignment by one or more threaded fasteners 159.

Figure 5:
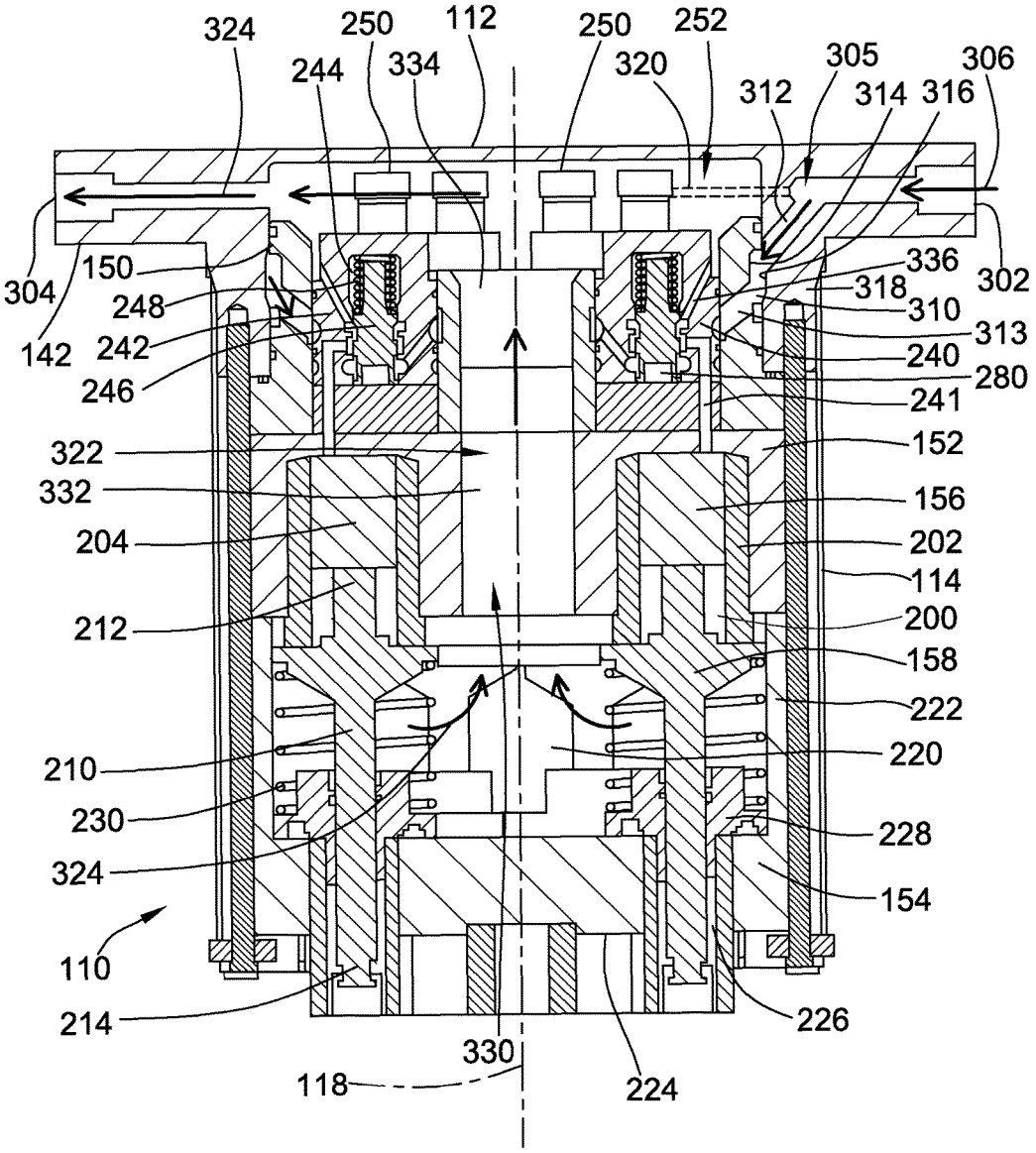
FIG. 5 is cutaway view of the drive assembly of the cryogenic pump.

Referring to FIG. 5, the tappet housing 152 can include a plurality of vertically arranged tappet bores 200 disposed therein and extending circumferentially around the pump axis 118, with the number of tappet bores corresponding to the number of tappets 156. Each tappet bore 200 may have a depth greater than the height of the tappets 156 to allow for vertical, up-and-down movement of the tappet within the bore. To facilitate sliding movement of the tappets 156, a plurality of tappet guides 202 can be installed, one each, into the plurality of tappet bores 200 by press fitting or threaded connections, for example. The tappet guides 202 can be tubular shaped objects of appropriate low-friction material that are delineate the tappet bore 200 and are sized to make sliding contact with the tappets 156 inserted therein. In other embodiments, the tappet bores may be machined directly into the tappet housing 152.

The tappets 156 themselves may be cylindrical, piston-like objects having a cylindrical periphery 204 corresponding to the shape of the tappet bores 200. Like the tappet bores 200, the tappets 156 installed therein are circumferentially arranged around the pump axis 118. It will be appreciated that the number of tappets 156 and the number of tappet bores 200 may correspond to the number of pumping elements in the pump assembly, for example, six. The pushrods 158, which are accommodated in the spring housing 154 disposed below the tappet housing 152, can have a rod extension 210, generally rod-like in shape and having a relatively small diameter relative to length, that extends between a first rod end 212 and a second rod end 214. The distance between the first and second rod ends 212, 214 can be dimensioned so that the first rod end projects upwardly into the tappet bore 200 while the second end protrudes through the spring housing 154.

To accommodate the plurality of pushrods 158, the spring housing 154 can have disposed therein a collection cavity 220, or an enclosed space in which the pushrods are located. In the embodiment shown, the enclosed collection cavity 220 can be formed by peripheral wall 222 extending upwardly from a spring housing floor 224. To enable the pushrods 158 to extend through the spring housing 154, the spring housing floor 224 can include a plurality of pushrod apertures 226 disposed therein and through which the second end 214 of the rod extension 210 can pass. The pushrod apertures 226 can be distributed circumferentially around the pump axis 118 radially outward toward the peripheral wall 222. The number of pushrods 158 accommodated in the spring housing 154 and, accordingly, the number of pushrod apertures 226 can be the same as the number of pumping elements in the pump assembly, for example, six. The collection cavity 220 can be sealed off from the pump assembly of the cryogenic pump by a plurality of pushrod seal assemblies 228 operatively associated with the pushrod apertures 226, which may include multiple parts to seal against, but enable sliding motion with respect to, the rod extensions 210. The collection cavity 220 thereby delineates an interior space to accommodate and facilitate vertically movement of the pushrods 158 within the spring housing 154. To vertically position the plurality of pushrods 158 within the spring housing 154, a plurality of pushrod springs 230 can be disposed within the collection cavity and operatively associated with each of the pushrods.

To regulate flow of hydraulic fluid within the hydraulic drive assembly 114, the spool housing 150 disposed under the pump flange 112 can accommodate a plurality of valves. According to one embodiment, the valves may be spool valves 240 such as shown in FIG. 5. The spool housing 150 can further include a plurality of tappet passages 241 that establish fluid communication between the spool valves 240 and the tappet housing 152 below. As is known in the art, spool valves 240 are hydraulic valves for controlling the direction of flow of hydraulic fluid. Each spool valve 240 can include a valve body 242 delineating an internal spool bore 244 in which a shuttle valve or spool 246 is slidably accommodated. The spool 246 is reciprocally movable within the valve body 242 due in part to the influence of a spool spring 248 urging against or biasing the position of the spool. The valve body 242 can further have a plurality of passages disposed therein that can be selectively opened to or closed off from the spool bore 244 by controlled movement of the spool 246. As will be familiar to those of skill in the art, different arrangements of the passages in the valve body 242 will dictate operation of the spool valve 240, such as whether the spool valve is configured as a two-way valve, three-way valve, etc.

The plurality of spool valves 240 can be arranged concentrically around or about the pump axis 118, with the direction of movement of the spools 246 in the spool bores 244 parallel to the pump axis. In the embodiments of the cryogenic pump 110 having six pumping elements 144, the spool housing 150 can include six spool valves 240 individually associated with and independently activating the pumping elements. Those skilled in the art will appreciate that other valves capable of directing movement of hydraulic fluid may be used in place of or in combination with the spool valves.

To actuate movement of the spool valves 240 within the valve bodies 242, and thereby selectively direct hydraulic fluid flow, each spool valve 240 can be operatively associated with one of a plurality of actuators 250. Each actuator 250 can be mounted on top of the valve body 242 and can project above the spool valve housing 150. To accommodate the top mounted actuators 250, there can be disposed in the pump flange 112, an actuator chamber 252. The actuator chamber 252 can collectively enclose the plurality of actuators 250 with the ceiling of the pump flange 112 extending overhead.

Figure 6:
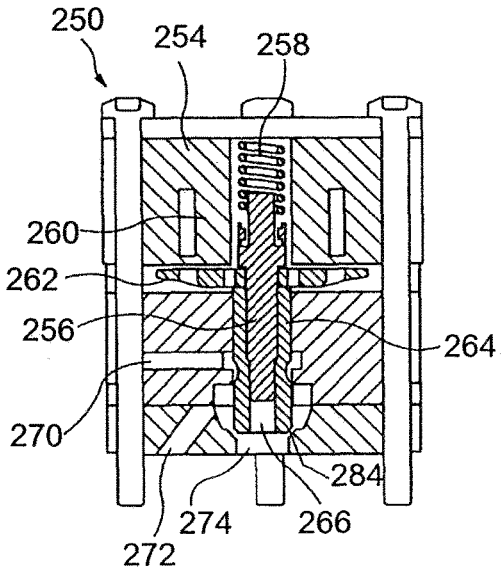
FIG. 6 is a section view of a hydraulic actuator of the drive system of the cryogenic pump.

One of the actuators 250 is shown in section view in FIG. 6. The illustrated actuator 250 is an electromechanical pilot actuator, but other actuator types such as actuators using piezoelectric elements can be used. The actuator 250 may include a solenoid 254 that, when energized, retracts a pin 256 that is reciprocally disposed at least partially in the solenoid 254 and includes a return spring 258. The solenoid may include a ferric core 260. The pin 256 may include an armature 262 and reciprocate within a pin guide 264 forming a hollow bore 266. The hollow bore 266 may be fluidly isolated from a hydraulic oil supply passage 270, a spool valve supply outlet 272, and a drain outlet 274. In the illustrated embodiment, the pin guide 264 forms two poppet valve seats that, depending on the activation state of the solenoid 254, fluidly connect or isolate the various fluid passages.

Figure 7:
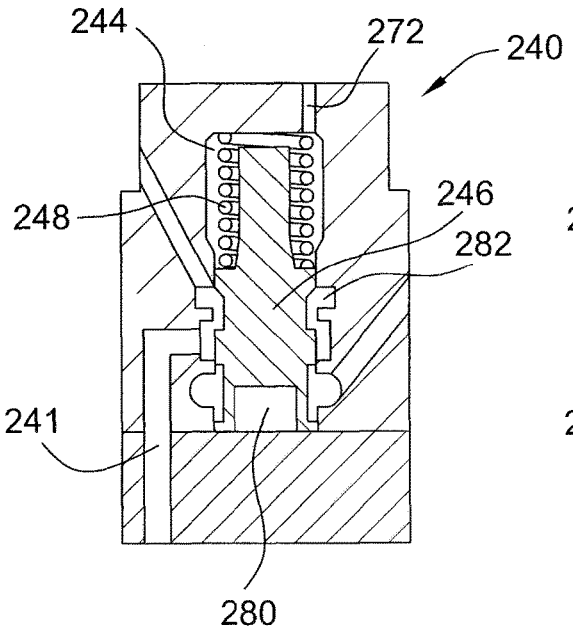
FIGS. 7 and 8 are section views of a spool valve of the drive system of the cryogenic pump in two operating conditions.
Figure 8:
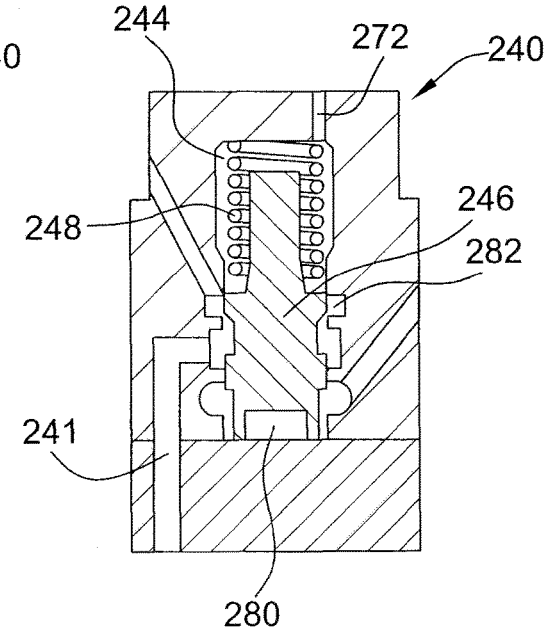

The spool valve 240 is shown in two operating positions in FIGS. 7 and 8. When the spool valve 240 is actuated as shown in FIG. 7, the spool 246 moves upward in the valve body 242 to open the tappet passage 241 to the flow of high pressure oil so the tappet housing 152 receives the high-pressure hydraulic fluid and utilizes it to slidably extend the tappets 156 accommodated therein. The bore 244, which accommodates the spool 246, may be fluidly connected to a fluid supply passage 280, which supplies pressurized fluid to move the tappet 156. The spool bore 244 may also be fluidly connected to a vent passage 282 (partially shown in FIGS. 7 and 8) for venting pressurized fluid. During operation, when the spool 246 is disposed at the fill position shown in FIG. 7, the vent passage 282 is fluidly isolated from the tappet passage 241. In the draining position, as shown in FIG. 8, the spool 246 moves to fluidly block the fluid supply passage 280 and in turn fluidly connect the tappet passage 241 with the vent passage 282. In this operating position, fluid flows out through the top of the tappet 156 or tappet bore, through the tappet passage 241 and into the vent passage 282, from where it is vented. These motions are facilitated by the pushrod spring 230 that pushes the pushrod 158, and thus the tappet 156, to retract.

The actuator 250 associated with the each spool valve 240 may be configured to move the spool 246 between the fill and drain positions. For example, depending on the activation state of the solenoid 254, the position of the pin 256 within the pin guide 264 may operate between an activation position and a drain position. In an activation position, a lower valve seat 284 opens as the armature 262 moves upward, which places the spool valve supply outlet 272 in fluid communication with the drain outlet 274, which may be in communication with the interior of the bore 244 of the spool valve 240 and depressurizes the area above the spool 246, causing the same to move upwards by hydraulic force under the spool 246 that is pressurized by fluid supply passage 280 from the drain position (FIG. 8) to the fill position (FIG. 7). Thus, when the pin 256 is in the activated position, the spool 246 is in the fill position. Similarly, when the pin 256 is deactivated, the spool valve supply outlet 272 is placed in fluid communication with the hydraulic oil supply passage 270, which pressurizes the area above the spool 246 to substantially the same pressure as the area under the spool and allows the spring 248 to extend the spool 246 in the spool bore 244 and thus vent the tappet passage 241. Thus, when the pin 256 is in the deactivated position, the spool 246 is in the drain position (FIG. 8). In other embodiments, the actuators 250 can include solenoid-operated plungers that connect directly to the spools 246 to cause movement of the spool within the spool bore 244. It should be appreciated that the actuators, spool valves and tappet passages may communicate with each other in configurations different than as illustrated in FIGS. 5-8.

Referring again to FIG. 5, to receive and discharge hydraulic fluid, the hydraulic drive assembly 114 of the cryogenic pump 110 includes a hydraulic fluid inlet 302 and a hydraulic fluid outlet 304 disposed in the flange shoulder 142 of the pump flange 112. The hydraulic fluid inlet 302 and the hydraulic fluid outlet 304 may be oriented perpendicular to the pump axis 118 and can be diametrically opposed to each other. The hydraulic fluid inlet 302 can receive pressurized hydraulic fluid from the hydraulic reservoir 122 and hydraulic pump 126 (see FIG. 1) while the hydraulic fluid outlet 304 discharges and returns low-pressure hydraulic fluid back to the hydraulic system. Moreover, the hydraulic fluid inlet and outlet 302, 304 can be internally threaded to mate with threaded connectors or otherwise configured to enable fluid connection with the respective hydraulic lines of the hydraulic system.

To direct the high-pressure hydraulic fluid from the fluid inlet 302 to the hydraulically powered elements associated with the hydraulic drive system of the cryogenic pump, a fluid inlet manifold 305 may be integrated into the hydraulic drive assembly 114 of the cryogenic pump. In particular, the fluid inlet manifold 305 may include various fluid passages in the pump flange 112 and the spool housing 150 that channel hydraulic fluid from the hydraulic fluid inlet 302 to the actuators 250 and the spool valves 240. In FIG. 5, the flow of hydraulic fluid through the inlet manifold 305 is shown by the arrows 306. To circulate the incoming high-pressure hydraulic fluid to each of the plurality of spool valves 240, the inlet manifold 305 can include a annular distribution passage 310. The annular distribution passage 310 may be in fluid communication with the fluid inlet 302 via a first passage 312 extending through the pump flange which, in this case, angles radially inwardly as it extends downward from the inlet towards the annular distribution passage 310. The annular distribution passage 310 may be formed by a groove that extends circumferentially around the outside of the spool housing 150 and be in fluid communication with each of the individual spool valves 240. In particular, the annular distribution passage 310 may communicate with the fluid supply passage 280 of each of the individual spool valves 240 via a further second passage 313 in the spool housing 150 which again may extend radially inwardly and downwardly as it travels from the annular distribution passage 310 to the respective spool valve 240. In the illustrated embodiment, the annular distribution passage 310 is defined at the interface between the spool housing 150 and the pump flange 112 and, in particular, by a radially outward facing surface 314 of the spool housing 150 and a radially inward facing surface 316 of the sidewall 318 of the pump flange 112. In other embodiments, the annular distribution passage 310 may have a different configuration and/or be defined by different surfaces than as shown in FIG. 5.

The inlet manifold 305 may further include one or more pilot passages 320 in the pump flange 112 that communicate with each of the actuators 250 and the fluid inlet 302. For example, the hydraulic oil supply passage 270 of each actuator 250 may be in communication with the hydraulic fluid inlet 302 of each respective actuator 250 via the pilot passages 320. Of course, in other embodiments, the actuators 250 may communicate with the fluid inlet 302 in other ways or actuators 250 may be used that do not utilize pressurized hydraulic fluid.

To help direct hydraulic fluid out of the cryogenic pump 110, the hydraulic drive assembly 114 may include a fluid outlet manifold 322 that communicates with the fluid outlet 304. In FIG. 5, the flow of hydraulic fluid through the outlet manifold 322 to the fluid outlet 304 is shown by the arrows 324. This return flow of hydraulic fluid through the fluid outlet manifold 322 to the fluid outlet 304 may be at a relatively low pressure. In the embodiment shown in FIG. 5, the outlet manifold 322 includes a center passage that operates as a return center passage 330 directing the hydraulic fluid upwardly and out the tappet housing 152 and the spool housing 150 as indicated by arrows 324. The return center passage 330 can be formed in part by a tappet housing return bore 332 disposed in the tappet housing 152 and by a spool housing return bore 334 disposed in the spool housing 150 respectively. In the illustrated embodiment, the return center passage 330 is centrally aligned with the pump axis 118 but in other embodiments may be arranged differently within the hydraulic drive assembly 114 including along other paths generally through the center of the array of spool valves 240 and tappets 156. Thus, as used herein, the terms "center" and "central" are not intended to exclusively designate alignment with the pump axis 118, but rather may also include other paths that extend through the areas circumscribed by the spool valves 240 and tappets 156.

The outlet manifold 322 may further include the actuator chamber 252 in the pump flange 112. In particular, the tappet housing return bore 332 and the spool housing return bore 334 can also communicate with the actuator chamber 252 formed which, in turn, communicates with the hydraulic fluid outlet 304. Accordingly, the continually rising hydraulic fluid can flow vertically upward in the return center passage 330 through the actuator chamber 252 then outwardly from the hydraulic drive assembly 114 via the hydraulic fluid outlet 304. In such an embodiment, the return center passage 330 and the actuator chamber 252 may be submerged in a continuous flow of hydraulic fluid circulating through the hydraulic drive assembly. Because the actuator chamber 252 disposed in the pump flange 112 may have a significant amount of hydraulic fluid flowing through it, the actuators 250 as electrical devices can be designed to operate in the presence of hydraulic fluid.

The outlet manifold 322 may be configured so as to communicate with, and thereby receive discharging hydraulic fluid from, one or more of the hydraulically powered components associated with the hydraulic drive system of the cryogenic pump 110. For example, motion of the tappet 156 upwards in the tappet bore 200 will displace the hydraulic fluid contained therein. A portion of that hydraulic fluid may be directed back up the respective tappet passage 241 into the spool valve 240 as described above. Accordingly, the outlet manifold 322 may include a spool discharge passage 336 for each of the spool valves 240 that communicates with the respective vent passage 282 of the spool valve 240 and extends into communication with the actuator chamber 252. The actuators 250 also may be configured such that any hydraulic fluid that is discharged from the actuators 250 as they operate to direct movement of the spool valves 240 is directed into the actuator chamber 252 from which the hydraulic fluid can exit the cryogenic pump 110 through the fluid outlet 304.

In addition to some hydraulic fluid being directed back up into the spool valves 240, some hydraulic fluid may also flow downwardly between the tappets 156 and the associated tappet bores 200, notwithstanding the sliding contact between the tappets and the tappet guides 202. To retain hydraulic fluid in the hydraulic drive assembly, the collection cavity 220 formed in the spring housing 154 is disposed underneath the tappet housing 152 with the bottoms of the tappet bores 200 exposed to the collection cavity. The collection cavity 220 may also provide a sealed enclosure for accommodating the hydraulic fluid and preventing it from further leaking into the pump assembly or the cryogenic tank. In some embodiments, the collection cavity 220 may form part of the outlet manifold 322 and be in communication with the return center passage 330 defined by the tappet housing return bore 332 and the spool housing return bore 334 such that oil collected in the collection cavity 220 may flow upward through the return center passage 330 through the actuator chamber 252 and out of the cryogenic pump via the fluid outlet 304.

Figure 9:
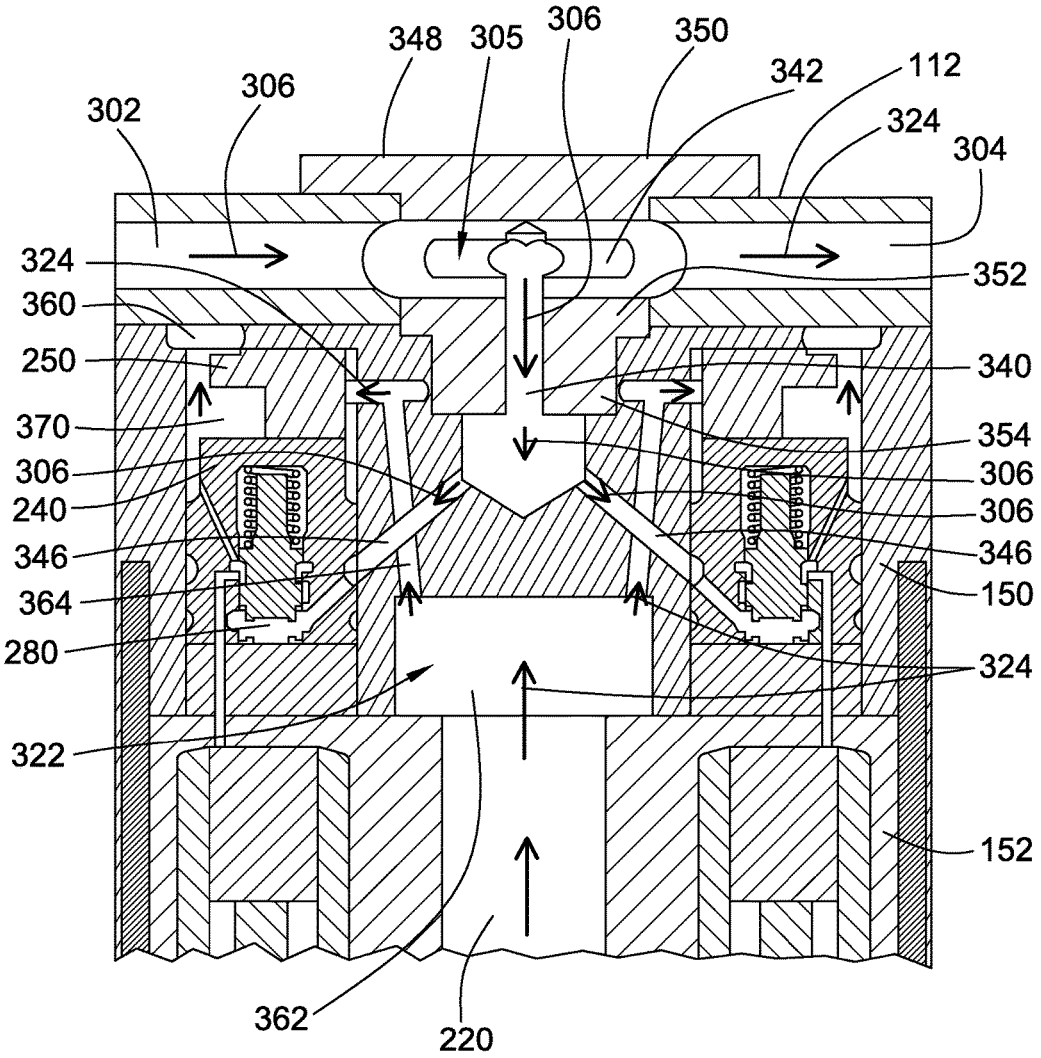
FIG. 9 is a cutaway, side view of an alternative embodiment of the drive assembly of the cryogenic pump.
Figure 10:
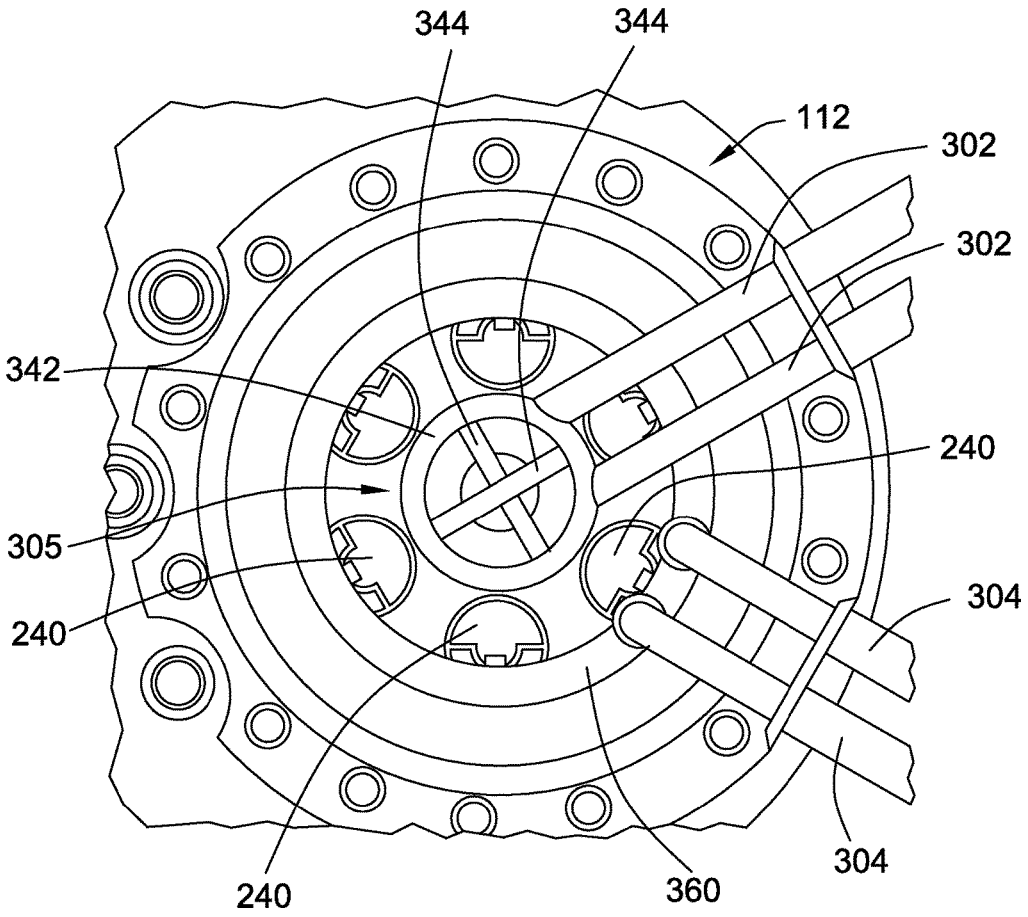
FIG. 10 is a cutaway, top view of the cryogenic pump of FIG. 9.

An alternative embodiment of the hydraulic drive assembly 114 of the cryogenic pump is shown in FIGS. 9 and 10. The embodiment of FIGS. 9 and 10 operates substantially similarly to the embodiment of FIGS. 1-8 and like components are given the same reference numbers as used in the embodiment of FIGS. 1-8. Additionally, as in FIG. 5, the flow of hydraulic fluid through the inlet manifold 305 is shown by the arrows 306 in FIG. 9. In contrast to an inlet manifold 305 with an annular distribution passage that supplies hydraulic fluid to the spool valves 240, the embodiment of FIGS. 9 and 10 has an inlet manifold 305 that directs incoming hydraulic fluid to a feed center passage 340 from which the hydraulic fluid is then distributed to each of the spool valves 240. The feed center passage 340 may be disposed in and extend through the space circumscribed by the spool valves 240. In particular, at least a portion of the feed center passage 340 may be defined by a central bore in an upper portion of the spool housing. As with the return center passage 330 of the embodiment of FIGS. 1-8, the feed center passage 340 may or may not be centrally aligned with the longitudinal axis of the cryogenic pump 110.

In the illustrated embodiment, the inlet manifold 305 of FIGS. 9 and 10 is fed hydraulic fluid from a pair of fluid inlets 302 in the pump flange 112, although it will be understood that only a single fluid inlet or more than two fluid inlets may be provided. The pair of fluid inlets 302, in this case, connect to a ring-shaped distribution passage that is arranged in a center portion of the pump flange 112 above the feed center passage 340 and above the center area of the spool housing 150 that is circumscribed by the spool valves 240. As best shown in the top view of FIG. 10, two cross passages 344 intersect with the ring-shaped distribution passage 342. These cross passages 344 communicate with the feed center passage 340 such that hydraulic fluid received through the fluid inlets 302 is directed from the ring-shaped distribution passage 342 to the cross passages 344 and on to the feed center passage 340. In other embodiments, the passages directing fluid from the one or more fluid inlets 302 to the feed center passage 340 may have configurations other than that specifically shown in FIGS. 9 and 10.

To distribute the hydraulic fluid from the feed center passage 340 to the spool valves 240, the inlet manifold 305 may include a plurality of distribution passages 346. Each distribution passage 346 may communicate with the feed center passage 340 and extend to a respective one of the spool valves 240 and, in particular, to the fluid supply passage 280 associated with the spool valve 240. As shown in FIG. 9, the distribution passages 346 may be configured so as to angle in a radial outward direction as they extend in the downward direction away from the central passage and towards the spool valves. Of course, the distribution passages 346 may be configured differently than as shown in FIGS. 8 and 9.

In the embodiment illustrated in FIGS. 9 and 10, at least a portion of the inlet manifold 305 is contained within a cap portion 348 that is received in the pump flange 112. In this case, the cap portion 348 includes therein the ring shaped distribution passage 342 and the cross passages 344. As best shown in FIG. 9, the cap portion 348 may be received in a central opening extending through the pump flange 112 between its upper and lower surfaces. The cap portion may have an enlarged head 350 that engages the upper surface of the pump flange 112 and a stem portion 352 that extends downward from the head 350 into the opening in the pump flange 112. A lower neck portion 354 may be arranged at a lower end of the cap portion 348 so as to extend into a central opening provided in the upper end of the spool housing 150. One or more annular seals may be provided on the neck portion to help seal against fluid leakage through the interface between the lower neck portion 354 and the spool housing 150. Similarly, one or more annular seals may be provided on the stem portion to help seal against fluid leakage through the interface between the stem portion 352 and the pump flange 112. Other sealing arrangements also could be used. Moreover, in other embodiments, the cap portion 348 may be eliminated and the uppermost components of the inlet manifold 305, including for example the ring-shaped distribution passage 342 and the cross passages 344, integrated into the pump flange 112.

The embodiment of FIGS. 9 and 10 may also include an outlet manifold 322 for directing hydraulic fluid out of the hydraulic drive assembly 114 of the cryogenic pump 110. In contrast to the outlet manifold 322 of the embodiment of FIGS. 1-8, which primarily directs discharging hydraulic fluid through the center of the tappet housing 152 and spool housing 150 to the pump flange 112, the outlet manifold embodiment of FIGS. 9 and 10 includes an annular drain passage 360 to which the discharging hydraulic fluid from the drive system is directed for ultimate removal from the cryogenic pump via the fluid outlet 304. As in FIG. 5, the flow of hydraulic fluid through the outlet manifold 322 to the fluid outlet 304 is shown by the arrows 324 in FIG. 9. In the illustrated embodiment, the annular drain passage 360 includes a groove in the upper surface of the spool housing 150 that extends circumferentially near the outside of the spool housing 150 and generally above the actuator 250 and spool valve 240 assemblies. More particularly, the annular drain passage 360 may be defined by a groove formed in an upper surface of the spool housing 150 that is closed off at the upper end by the lower surface of the pump flange 112. In other embodiments, the annular drain passage 360 may have a configuration or location different than that shown in FIGS. 9 and 10. The embodiment of FIGS. 9 and 10 includes two fluid outlets 304 each of which is in communication with the annular drain passage 360 and extends through the pump flange 112 and exits through the shoulder of the flange. Of course, any number of fluid outlets 304 may be provided including a single fluid outlet or more than two fluid outlets.

To direct hydraulic fluid that has drained from the tappets 156 into the collection cavity 220 to the fluid outlets 304, the outlet manifold 322 may include a tappet return passage 362 that communicates with the collection cavity. The tappet return passage 362 may extend through, in this case, a center portion of the tappet housing 152 and into a lower portion of the spool housing 150 where the tappet return passage 362 may terminate. The outlet manifold 322 may further include a plurality of discharge passages 364 may that extend upward from the return passage. Each discharge may extend to a respective actuator 250 and spool valve 240 assembly. More specifically, each discharge passage 364 may communicate with a drain cavity 370 associated with the respective actuator 250 and spool valve 240 assembly. In the illustrated embodiment, the discharge passages 364 angle in a radial outward direction as they extend upward from the tappet return passage 362 toward the respective actuator 250 and spool valve 240 assembly. The drain cavities 370 may be formed in the spool housing 150 above the valve body 242 of the respective spool valve 240 and further may be configured so as to be in fluid communication with the annular drain passage 360. Each drain cavity also may be in communication with the vent passage 282 associated with the respective spool valve 240 to receive hydraulic fluid discharging from the spool valve 240. Moreover, in those embodiments in which the actuators 250 receive a portion of the incoming hydraulic fluid to actuate the spool valves 240, the actuators may be configured to discharge that fluid into the respective drain cavity 370.

Thus, with the outlet manifold 322 of the embodiment of FIGS. 9 and 10, hydraulic fluid may be directed upward from the collection cavity 220 into the tappet return passage 362 which extends generally in the center of the hydraulic drive assembly 114 of the cryogenic pump. This hydraulic fluid then may be directed in the radially outward direction to the drain cavities 370 by the respective discharge passages 364. The drain cavities 370 may further collect hydraulic fluid draining from the spool valves 240 and the actuators 250. The hydraulic fluid in the drain cavities 370 may then be directed into the annular drain passage 360 from which it can exit the cryogenic pump 110 via the fluid outlets 304.

INDUSTRIAL APPLICABILITY

The circulation through and utilization of hydraulic fluid in the cryogenic pump 110 may be as follows. High-pressure hydraulic fluid, such as oil, is received by the cryogenic pump 110 through the hydraulic fluid inlet 302 and is directed downwardly by the inlet manifold 305, as indicated by the arrows 306. Under operation of the electronic controller, individual actuators 250 may be actuated to further actuate the associated spool valves 240 between different positions in a suitable manner or pattern to direct hydraulic fluid through the cryogenic pump 110. For example, the plurality of spool valves 240 may be shifted to open the tappet passages 241 to the tappets 156 one at a time in a sequential, clockwise pattern around the pump axis 118 or any other pattern that is beneficial to the cryogenic pump 110. However, in other embodiments, multiple spool valves 240 can be opened and closed at the same time. Further, the duration and sequencing can be varied during operation depending upon the quantity of LNG needed by the combustion process.

When the spool valves 240 are appropriately positioned, high pressure hydraulic fluid is able to flow through the tappet passages 241 disposed in the tappet housing 152 into the tappet bores 200. The pressurized hydraulic fluid can urge and slide the tappets 156 vertically downward in the tappet bores 200 with respect to the pump axis 118. It will be appreciated that the downward motion of the tappets also causes the pushrods 158 associated with a particular tappet to move downward with respect to the spring housing 154 and compress the relative pushrod spring 230 against the spring housing floor 224 and pushrod seal assembly 228. Due to the connection between the pushrods and the connecting rods, it can be further appreciated that downward motion of a pushrod also causes the associated connecting rod to move similarly downwards, ultimately activating the pumping elements in the pump assembly causing them to direct LNG toward the internal combustion engine.

A particular tappet 156 can remain downwardly disposed in the tappet bore 200 so long as the associated spool valve 240 remains in a position directing high-pressure hydraulic fluid to the tappet passage 241. However, when the spool valve 240 is positioned to stop flow of high-pressured hydraulic fluid into the tappet passage 241 and instead allows fluid to drain from the tappet bore 200, the pushrod spring 230 can urge the pushrod 158 vertically back upwards and into the tappet bore thereby slidably moving the tappet 156 against the upward face of the tappet bores. Vertically upward movement of the pushrod 158 will also allow the associated connecting rod to move vertically upwards and disengage the pumping element in the pump assembly.

The hydraulic drive system of the present disclosure is applicable to a variety of different cryogenic pump configurations. Moreover, the inlet and outlet manifolds of the present disclosure provide a particularly compact design. In particular, the inlet manifold utilizes common inlet manifold passages to deliver hydraulic fluid from the fluid inlet to multiple hydraulic components of the drive system. Similarly, the outlet manifold utilizes common outlet manifold passages to receive draining hydraulic fluid from multiple hydraulic components of the drive system and direct it towards the fluid outlet. This arrangement of the inlet and outlet manifolds may allow the hydraulic drive system to be fit into more compact sockets in cryogenic tanks, including existing cryogenic tank sockets. Additionally, the arrangement of the inlet and outlet manifolds can minimize external connections to the cryogenic pump which can help control heat transfer to the tank.

This disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A cryogenic pump for pumping liquid from a cryogenic tank comprising:

a pump assembly adapted to be submersed within a cryogenic tank; and a hydraulic drive assembly for driving the pump assembly to pump liquid;

wherein the hydraulic drive assembly further includes:

a spool housing having a plurality of valves disposed therein about a pump axis;

a tappet housing including a plurality of tappet bores, each tappet bore in communication with a respective one of the plurality of valves;

a collection cavity for collecting hydraulic fluid from the tappet bores;

a pump flange for mounting the cryogenic pump to a cryogenic tank, the pump flange including a fluid inlet for receiving hydraulic fluid and a fluid outlet for directing hydraulic fluid out of the cryogenic pump;

an inlet manifold disposed at least partially in the spool housing for directing hydraulic fluid received through the fluid inlet to each of the plurality of valves; and an outlet manifold disposed at least partially in the spool housing for directing hydraulic fluid from each of the valves and the collection cavity to the fluid outlet.

2. The cryogenic pump of claim 1 further including a center passage disposed at least partially in a space in the spool housing that is circumscribed by the plurality of valves and an annular passage disposed at least partially in the spool housing, wherein the inlet manifold includes one of the center passage and the annular passage and the outlet manifold includes the other of the center passage and annular passage.

3. The cryogenic pump of claim 2 wherein the inlet manifold includes the annular passage and the annular passage includes a groove in an outer wall of the spool housing and wherein the annular passage is defined at an interface between the pump flange and the spool housing with the groove in the outer wall of the spool housing being closed by the pump flange.

4. The cryogenic pump of claim 2 wherein the inlet manifold includes the annular passage and the inlet manifold further includes a first passage that communicates with the fluid inlet and the annular passage and a plurality of second passages each of which communicates with the annular passage and a supply passage associated with a respective one of the valves.

5. The cryogenic pump of claim 2 wherein the outlet manifold includes the center passage and the center passage communicates with a chamber in the pump flange, the chamber in the pump flange being in communication with the fluid outlet.

6. The cryogenic pump of claim 5 wherein the outlet manifold includes a plurality of valve discharge passages with each valve discharge passage in communication with a vent passage of a respective one of the valves and the chamber in the pump flange.

7. The cryogenic pump of claim 2 wherein the inlet manifold includes the center passage and further includes a plurality of feed passages each of which communicates with the center passage and a supply passage of a respective one of the valves.

8. The cryogenic pump of claim 7 wherein the inlet manifold includes a ring-shaped distribution passage that is arranged above the center passage.

9. The cryogenic pump of claim 2 wherein the outlet manifold includes the annular passage and the annular passage includes a groove in an upper surface of the spool housing.

10. A drive system for a cryogenic pump comprising:

a spool housing having a plurality of valves disposed therein about a pump axis;

a tappet housing including a plurality of tappet bores, each tappet bore in communication with a respective one of the plurality of valves;

a collection cavity for collecting hydraulic fluid from the tappet bores;

a pump flange for mounting the cryogenic pump to a cryogenic tank, the pump flange including a fluid inlet for receiving hydraulic fluid and a fluid outlet for directing hydraulic fluid out of the cryogenic pump;

an inlet manifold disposed at least partially in the spool housing for directing hydraulic fluid received through the fluid inlet to each of the plurality of valves; and an outlet manifold disposed at least partially in the spool housing for directing hydraulic fluid from each of the valves and the collection cavity to the fluid outlet.

11. The drive system of claim 10 further including a center passage disposed at least partially in a space in the spool housing that is circumscribed by the plurality of valves and an annular passage disposed at least partially in the spool housing, wherein the inlet manifold includes one of the center passage and the annular passage and the outlet manifold includes the other of the center passage and annular passage.

12. The drive system of claim 11 wherein the inlet manifold includes the annular passage and the annular passage includes a groove in an outer wall of the spool housing and wherein the annular passage is defined at an interface between the pump flange and the spool housing with the groove in the outer wall of the spool housing being closed by the pump flange.

13. The drive system of claim 11 wherein the outlet manifold includes the center passage and the center passage communicates with a chamber in the pump flange, the chamber in the pump flange being in communication with the fluid outlet and wherein the outlet manifold includes a plurality of valve discharge passages with each valve discharge passage in communication with a vent passage of a respective one of the valves and the chamber in the pump flange.

14. The drive system of claim 11 wherein the inlet manifold includes the center passage and further includes a plurality of feed passages each of which communicates with the center passage and a supply passage of a respective one of the valves and wherein the inlet manifold includes a ring-shaped distribution passage that is arranged above the center passage.

15. The drive system of claim 11 wherein the outlet manifold includes the annular passage and the annular passage includes a groove in an upper surface of the spool housing.

16. A power system for a machine comprising:

a cryogenic tank for storing a cryogenic fluid;

an engine operatively associated with the cryogenic tank for receiving the cryogenic fluid;

a hydraulic system including a hydraulic pump and a hydraulic reservoir;

a cryogenic pump arranged in the cryogenic tank, the cryogenic pump having a pump assembly submersed within the cryogenic tank and a hydraulic drive assembly for driving the pump assembly to pump the cryogenic liquid, wherein the hydraulic drive assembly further includes:

a spool housing having a plurality of valves disposed therein arranged about a pump axis;

a tappet housing including a plurality of tappet bores, each tappet bore in communication with a respective one of the plurality of valves;

a collection cavity for collecting hydraulic fluid from the tappet bores;

a pump flange for mounting the cryogenic pump to the cryogenic tank, the pump flange including a fluid inlet in communication with the hydraulic pump and a fluid outlet in communication with the hydraulic reservoir;

a center passage disposed at least partially in a space in the spool housing that is circumscribed by the plurality of valves;

an annular passage disposed at least partially in the spool housing;

an inlet manifold for directing hydraulic fluid received through the fluid inlet to each of the plurality of valves, the inlet manifold including one of the center passage and the annular passage; and an outlet manifold for directing hydraulic fluid from each of the valves and the collection cavity to the fluid outlet, the outlet manifold including the other of the center passage and the annular passage.

17. The power system of claim 16 wherein the inlet manifold includes the annular passage and the annular passage includes a groove in an outer wall of the spool housing and wherein the annular passage is defined at an interface between the pump flange and the spool housing with the groove in the outer wall of the spool housing being closed by the pump flange.

18. The power system of claim 16 wherein the outlet manifold includes the center passage and the center passage communicates with a chamber in the pump flange, the chamber in the pump flange being in communication with the fluid outlet and wherein the outlet manifold includes a plurality of valve discharge passages with each valve discharge passage in communication with a vent passage of a respective one of the valves and the chamber in the pump flange.

19. The power system of claim 16 wherein the inlet manifold includes the center passage and further includes a plurality of feed passages each of which communicates with the center passage and a supply passage of a respective one of the valves and wherein the inlet manifold includes a ring-shaped distribution passage that is arranged above the center passage.

20. The power system of claim 16 wherein the outlet manifold includes the annular passage and further includes a tappet return passage in the tappet housing and a lower portion of the spool housing and includes a plurality of discharge passages each of which extends from the tappet return passage to a drain cavity associated with a respective one of the valves and wherein the drain cavities are in communication with the annular passage.

* * * * *